US005263635A

United States Patent [19]

Fitzgerald

[11] Patent Number: 5,263,635

[45] Date of Patent: Nov. 23, 1993

[54] POSTAL TRAY AND SUPPORT FOR STACKING AND TRANSPORTING SAME

[75] Inventor: Robert J. Fitzgerald, Burbank, Ill.

[73] Assignee: Richard L. Fleury, Alsip, Ill.

[21] Appl. No.: 946,622

[22] Filed: Sep. 18, 1992

[51] Int. Cl.[5] ..... B65D 5/22; B65D 5/66

[52] U.S. Cl. ..... 229/149; 206/45.29; 229/23 R; 229/114; 229/125; 229/150; 229/151; 229/177; 229/178; 229/915; 229/916

[58] Field of Search ..... 229/23 R, 125, 149, 229/150, 151, 177, 178, 114, 915, 916, 919, DIG. 1; 206/386, 45.29, 45.30

[56] References Cited

U.S. PATENT DOCUMENTS

| | | | |
|---|---|---|---|
| 1,609,186 | 11/1926 | Peruzzi | 229/125 |
| 2,319,919 | 5/1943 | Clark | 229/154 |
| 2,534,010 | 12/1950 | Frye | 229/23 R |
| 2,915,235 | 12/1959 | Rueckert | 229/23 R |
| 3,021,044 | 2/1962 | Schubert | 206/386 |
| 3,023,945 | 3/1962 | Layne, Sr. | 229/154 |
| 3,112,058 | 11/1963 | Martin | 229/149 |
| 3,310,219 | 3/1967 | Dlugopolski | 229/178 |
| 3,357,628 | 12/1967 | Fish | 229/23 R |
| 3,385,424 | 5/1968 | Thompson et al. | 229/154 |
| 3,826,420 | 7/1974 | Bamburg et al. | 229/151 |
| 3,889,868 | 6/1975 | Bruckner et al. | 229/125 |
| 3,933,300 | 1/1976 | Dempster | 229/149 |
| 4,168,028 | 9/1979 | McCall | 229/178 |
| 4,365,710 | 12/1982 | Swanson | 206/386 |
| 4,693,411 | 9/1987 | Snyder | 229/23 R |
| 4,913,290 | 4/1990 | deGroot | 206/386 |

FOREIGN PATENT DOCUMENTS

| | | | |
|---|---|---|---|
| 20171 | 12/1980 | European Pat. Off. | 229/23 R |
| 1512508 | 2/1968 | France | 229/149 |
| 1526302 | 9/1978 | United Kingdom | 229/149 |

OTHER PUBLICATIONS

The Wiley Encyclopedia of Packaging Technology, John Wiley & Sons, pp. 492,493 (1986).

*Primary Examiner*—Gary E. Elkins
*Attorney, Agent, or Firm*—Baker & McKenzie

[57] ABSTRACT

A Container for the storage, transport and handling of bulk mail is provided. The container includes a top panel that is adequately secured in place thereby eliminating the need for a separate tray, elastic strap and sleeve. A plurality of containers, in combination with a pallet, top and bottom caps and side enclosures provide an improved method for the shipment of large quantities of bulk mail and eliminates the need for shrink wrapping conventional sleeves onto pallets.

18 Claims, 3 Drawing Sheets

83
85
87
80
91
90
10a
10b
10c
10d
10e
10f
10
94
89
93
86
92
88
82
81
84

87
85
90
10a
10b
10c
10d
91
94
93
88
10e
10f
89
83
86
84

22
32
62
12
99
27
29
14
31
21
17
24
23
102
26
11
28
15
25
34
13

POSTAL TRAY AND SUPPORT FOR STACKING AND TRANSPORTING SAME

This invention relates generally to containers and systems for the storage, handling and transport of bulk mail. Specifically, the invention relates to an improved container or tray for the stacking and sorting of bulk mail and an improved system for transporting groups of the containers easily and efficiently.

BACKGROUND OF THE INVENTION

Mass mailing, or bulk mailing, has become one of the basic forms of advertising products and services. A substantial percentage of the mail handled by the U.S. postal service consists of advertisements, form letters and brochures that are sent out by the thousands, and sometimes by the millions. In exchange for the large volume of business, the postal service mails these bulk mail items at a lower rate thereby making bulk mail advertising campaigns a cost efficient way to advertise goods and services.

In order to justify the lower postage rates charged to bulk mail customers and to enable the postal service to earn a profit on bulk mailing, the postal service requires bulk mail to be provided to them in a sorted and organized fashion. To accomplish this objective, sorted bulk mail is conventionally supplied to the postal service in open-top trays normally fabricated from plastic or polyethylene.

The sorted bulk mail is placed into the trays and an elastic strap is wound around the tray lengthwise to prevent the sorted bulk mail from falling out and further to satisfy a postal requirement that the bulk mail be secured in the trays. The trays are then placed into elongated sleeves. The sleeves are placed on pallets and the postal service requires the sleeves to be secured the pallets. The common procedure is to employ shrink wrap to secure the trays to the pallets.

The above procedure is inefficient for a number of reasons. First, it is awkward, inconvenient and expensive to require both trays and sleeves. Further, it is also inefficient to place an elastic strap around the tray. A far better system would provide a single container in place of the tray, sleeve and strap. Finally, thousands of pounds of plastic are wasted each year by needlessly shrink wrapping the sleeves with trays onto the pallets prior to shipment and handling.

Thus, there is a need for an improved single container for the handling and shipment of bulk mail and a shipment system that can be reused thereby eliminating the need for shrink wrap. The present invention satisfies these needs.

BRIEF DESCRIPTION OF THE INVENTION

The present invention satisfies the aforenoted objectives first by providing an improved container for the sorting, handling and shipment of bulk mail and, second, by providing an improved system for the transport of a plurality of containers.

The container may be fabricated from a single blank and includes a flat, rectangular bottom. The bottom is foldably attached to two sidewalls, a front panel and a rear panel. A top panel, which eliminates the need for an elastic strap, is foldably connected to the rear panel and further includes a front closure flap.

Each sidewall provides a means for holding and restraining the front and rear panels in the upright positions as follows. Each sidewall includes an outer wall which is foldably attached to the bottom, and an inner wall which is foldably attached to the top of the outer wall. The inner wall folds inward and downward and is locked to the bottom panel of the container. Thus, a space is created between the inner and outer wall of each end. This space accommodates flaps attached to opposing ends of the front and rear panels.

To form the box, the front and rear panels are folded upward to an upright position and the flaps of the front and rear panels are folded inward and directed at about 90 degree angles from the front and rear panels. Then the outer walls of the ends are folded upward and the inner walls of the ends are folded inward and downward thereby locking the flaps of the front and rear panels in place and further securing the sidewalls of the container in an upright position as the lower edge of the inner wall is locked to the bottom panel of the container.

In the preferred embodiment, the flaps of the front panel fit loosely in the space between the inner and outer walls of the ends. This loose fit provides room to accommodate locking flaps disposed on either side of a front closure panel which is attached to the top. As the top is closed, the front closure panel is folded downward against the front panel and the locking flaps disposed at either end of the front closure panel are accommodated in the sidewalls alongside the flaps disposed on either side of the front panel.

In the preferred embodiment, an elongated aperture is provided along the upper edge of the sidewalls, or the common boundaries of the inner and outer walls of each sidewall. Two alignment tabs are provided on opposing ends of the top panel. As the top is closed, the two alignment ends each engage an aperture at the upper edge of a sidewall. The engagement of the alignment tabs in the apertures of the sidewalls helps align the top in place as it is closed.

Further, access holes may be provided in each sidewall by two holes formed in each outer wall and inner wall. As the inner wall is folded over and downward and locked to the bottom panel, the access holes in the inner and outer walls are in matching registry. The alignment tabs preferably extend down through an aperture and through the access hole formed in the inner wall of each sidewall. The access holes in each sidewall provide handles and as a human hand extends through the access holes, the hand further grips the lower distal end of the alignment tabs further securing the top in the closed position as the container is handled.

The present invention also supplies a system for handling dozens of filled containers at once. The preferred dimensions of the containers are such that six containers will fit on a standard sized pallet in one layer. Before the containers are placed on the pallet, a bottom cap substantially covering the upper surface of the pallet is placed on the pallet. Six layers of six containers totalling thirty-six containers are stacked on the bottom cap. Because the layer of six containers must fit on top of a conventional or standard size pallet having dimensions of 40 inches by 48 inches, the length of the container should be from about 20 inches to about 24 inches and the width of the containers should be about from 9 inches to about 11 inches. Two side enclosures are placed around the stacked containers and the side enclosures lockingly engage each other to form a sturdy enclosure for the thirty-six containers. Finally, a top cap is placed on top which matably engages the top layer of the thirty-six containers and the side enclosures. Once the top cap is in place, the thirty-six containers are ready to be transported with a forklift without the need for disposable shrink wrap.

It is therefore an object of the present invention to provide an improved container for the transport, handling and sorting of bulk mail.

It is another object of the present invention to provide an improved system for the transport and handling of large quantities of containers filled with bulk mail.

BRIEF DESCRIPTION OF THE DRAWINGS

This invention is illustrated more or less diagrammatically in the accompanying drawings, wherein.

DETAILED DESCRIPTION OF THE INVENTION

Figure 1:
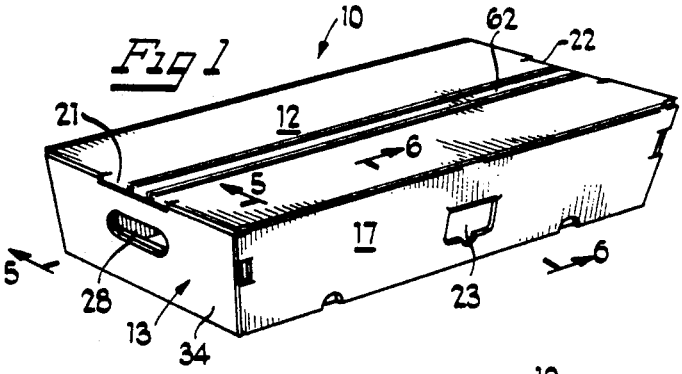
FIG. 1 is a perspective view of a container made in accordance with the present invention, the container being in the closed position.

Like reference numerals will be used to refer to like or similar parts from Figure to Figure in the following description of the drawings.

The dramatic improvement contributed by this invention is best understood after consideration of the conventional method for transporting and handling bulk mail. Letters are stacked in open-top trays of similar dimensions to the containers shown in the drawings. To keep the letters from falling out of the trays during handling and to satisfy postal service requirements, an elastic band or strap is placed lengthwise the trays. Then, the postal service requires the trays to be placed in individual sleeves. The sleeves are stacked on a pallet and, to keep the sleeves from falling off the pallet, the sleeves are shrink wrapped to the pallet. After one use, the shrink wrap is normally discarded.

As seen in FIG. 1, the improved container 10 disposes of the need for a separate elastic band and a separate sleeve. The container 10 includes a bottom 11 (see FIG. 7), a top 12, two side walls 13, 14 (see FIG. 4), a front panel 15 (see FIG. 4), a rear panel 16 (see FIG. 4) and a front closure flap 17. FIG. 1 is an illustration of the container 10 in the closed position or the position for movement of the container 10 after it is filled with bulk mail. The top 12 is maintained in the closed position by the locking flaps 18, 19 (see FIG. 2) of the front closure flap 17. Further, the top 12 is held in place by the alignment tabs 21, 22 (only partially shown in FIG. 1; see FIG. 4). Thus, the top 12, the front closure flap 17, the locking flaps 18, 19 and the alignment tabs 21, 22 combine to eliminate the need for the additional elastic strap and effectively keep the bulk mail in place inside the container 10.

Figure 2:
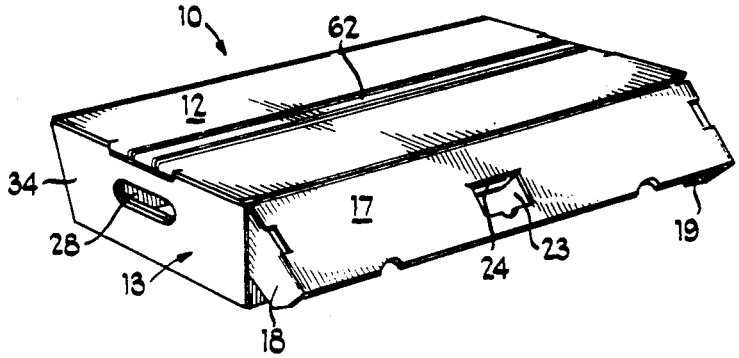
FIG. 2 is a perspective view of the container shown in FIG. 1 with the front closure flap partially open and the locking flaps partially exposed.

FIG. 2 illustrates the container 10 in a partially open position. As will be discussed below, the locking flaps 18, 19 of the front closure flap 17 engage a space provided in the side walls 13, 14. The side walls 13, 14 also provide a means for holding and restraining the front panel 15 and the rear panel 16 (see FIG. 4) in the upright position which will also be discussed below. An additional locking means may be provided by the access hole 23 and flap 24. The flap 24 folds inwardly and upwardly through the hole 25 in the front panel 15 (see FIG. 4) to further secure the front closure panel 17 and therefore the top 12 in the closed position.

Figure 3:
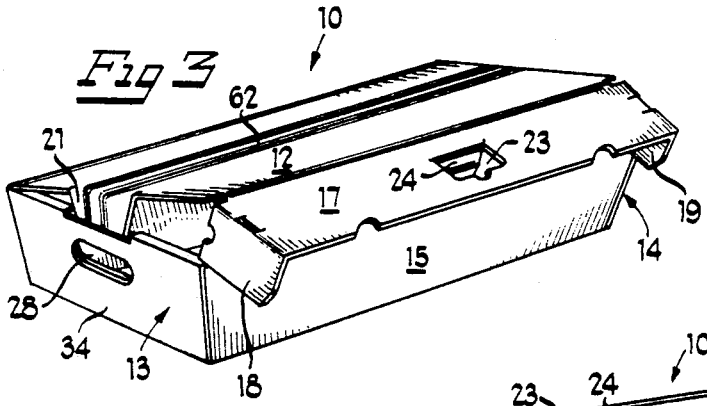
FIG. 3 is a perspective view of the container shown in FIG. 1 with the front closure flap and locking flaps disengaged and the top panel partially open with a portion of the left alignment tab exposed.
Figure 4:
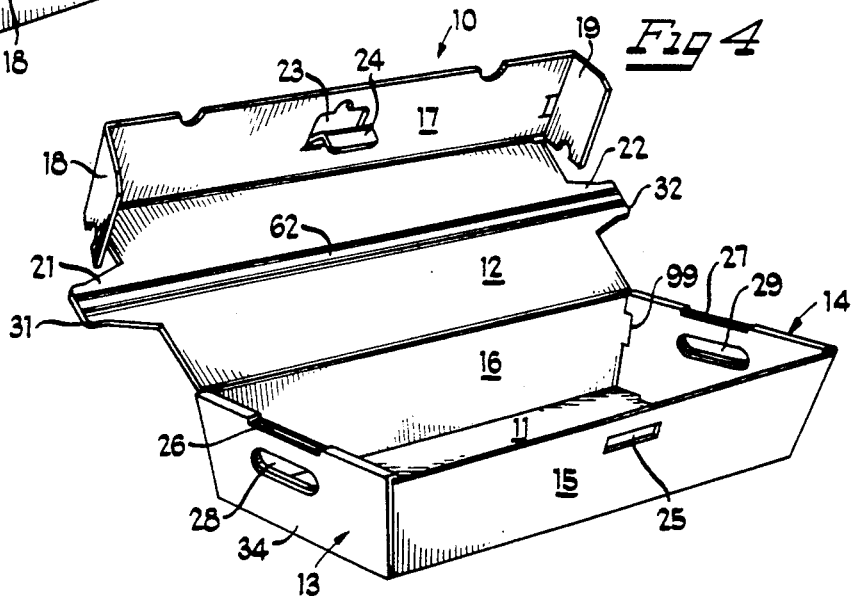
FIG. 4 is a perspective view of the container shown in FIG. 1 with the top panel in the open position.

FIG. 3 is an illustration of the container 10 as is moved from the closed position to the open position shown in FIG. 4. The alignment tab 21 is partially disengaged from the aperture 26 (see FIG. 4) and the locking flaps 18 and 19 are completely disengaged from the side walls 13, 14. It will be noted that the alignment tabs 21, 22 extend downward through the apertures 26, 27 to further extend inward through the access holes 28, 29 (see also FIG. 4). When the box 10 is in the closed position as shown in FIG. 1, the person handling the container 10 extends his/her hands through the access holes 28, 29 to engaged the lower distal ends 31, 32 of the alignment tabs. This action further secures the top 12 in place. The means for securing the top 12 in the closed position provided by the alignment tabs 21, 22 and the flap 24 is best illustrated in FIGS. 5 and 6.

Figure 5:
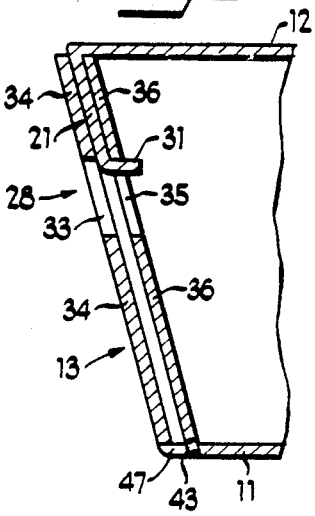
FIG. 5 is a partial sectional view of the container shown in FIG. 1 taken along line 5—5.

FIG. 5 illustrates the lower distal end 31 of the alignment tab 21 as it extends inward through the access hole shown generally at 28. The access hole is created by a first hole 33 placed in the outer wall 34 of the side wall 13. The second hole 35 which is placed in the inner wall 36 of the side wall 13. The second hole 35 is in matching registry with the first hole 33 after the inner wall 36 is folded inward and downward to lock into place via the locking tab 43 and the slot 47 in the bottom panel 11. As can be seen in FIG. 5, if a hand is inserted through access hole 28 in the direction of the arrow, the hand will naturally grip the distal end 31 of the alignment tab 21 which, of course, will further secure the top panel 12 in the closed position.

Figure 6:
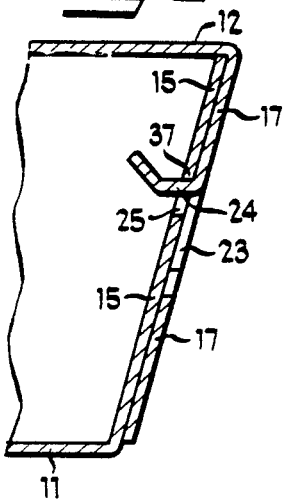
FIG. 6 is a partial sectional view of the container shown in FIG. 1 taken along line 6—6.

Turning to FIG. 6, the flap 24 operates in a similar manner. The flap 24 extends through the hole 25 in the front panel 15 and is bent upward to positively engage the upper lip 37 of the front panel 15. The engagement of the flap 24 with the hole 25 further secures the top panel 12 in the closed position. The combination of the holes 23, 25 provide a front handle.

Figure 7:
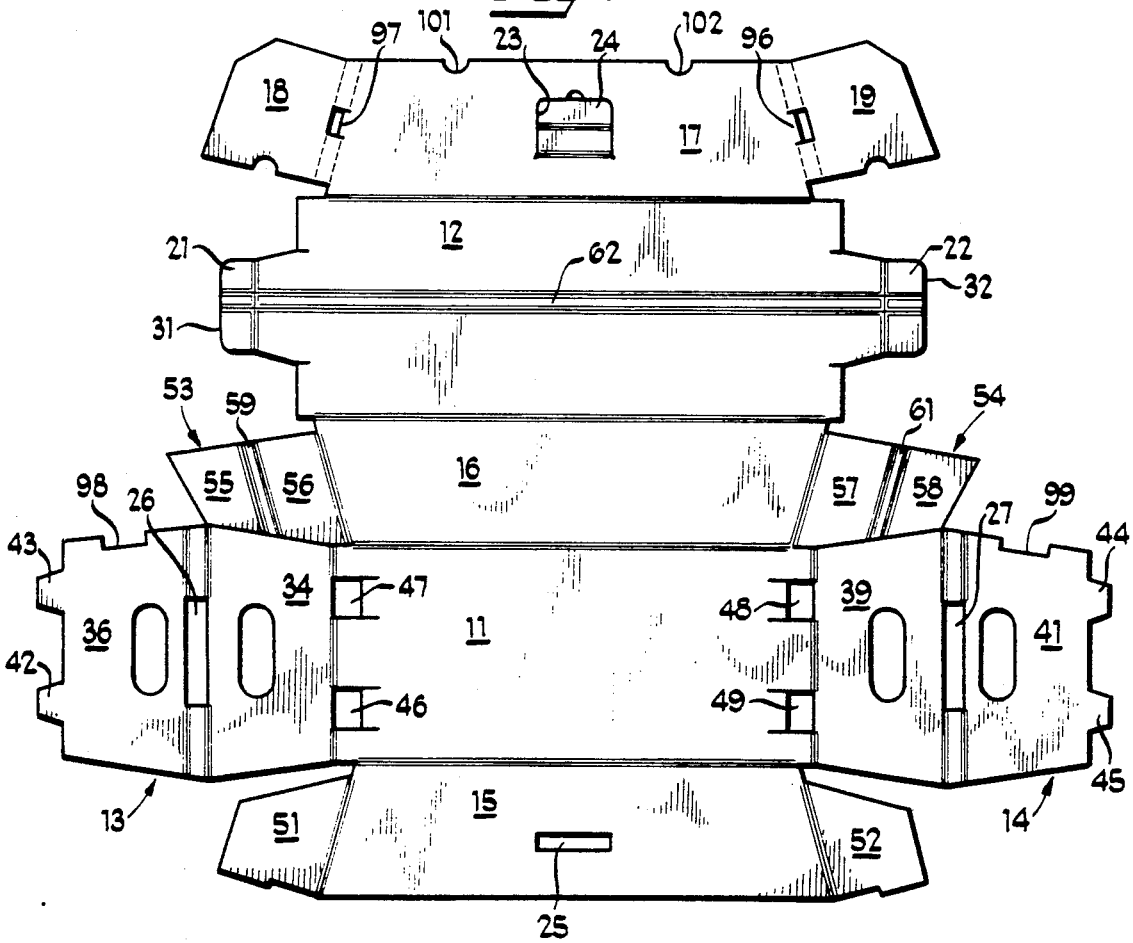
FIG. 7 is a top plan view of a blank used to form the container shown in FIG. 1.

FIG. 7 is a top view of a blank 10 which is used to fabricate the container 10 shown in the other figures. The bottom panel 11 is foldably attached to the front panel 15, the rear panel 16, and the outer walls 34, 39 of the side walls 13, 14 respectively. The side walls 13, 14 are constructed by folding the inner walls 36, 41 inward and downward so that the locking tabs shown at 42, 43, 44, 45 engage the slots in the bottom panel 11 shown at 46, 47, 48, 49. The inner walls 36, 41 are folded over, in and down after the front-end flaps 51, 52 and the rear interference flaps 53, 54 are in place and the front panel 15 and rear panel 16 are in the upright position. It will be noted that two flaps, namely 51, 18 on the left and 52, 19 on the right engage the front space provided between the inner and outer walls of the left side wall 13 and right side wall 14. To compensate for the fact that two flaps are inserted into the front spaces at the front end of the box, the rear interference flaps 53, 54 actually comprise two flaps 55, 56 and 57, 58 which fold backward on the fold lines 59, 61. Thus, an even amount of material is inserted into the front and rear portions of the spaces provided between the outer (34, 39) and inner (36, 41) walls of the side walls 13, 14.

Also to be noted in FIG. 7 is the fold line 62 which extends from the left alignment tab 21 to the right alignment tab 22. The fold line 62 enables the top 12 to be folded inward and down to assume the container-loading position best shown in FIG. 10.

Figure 8:
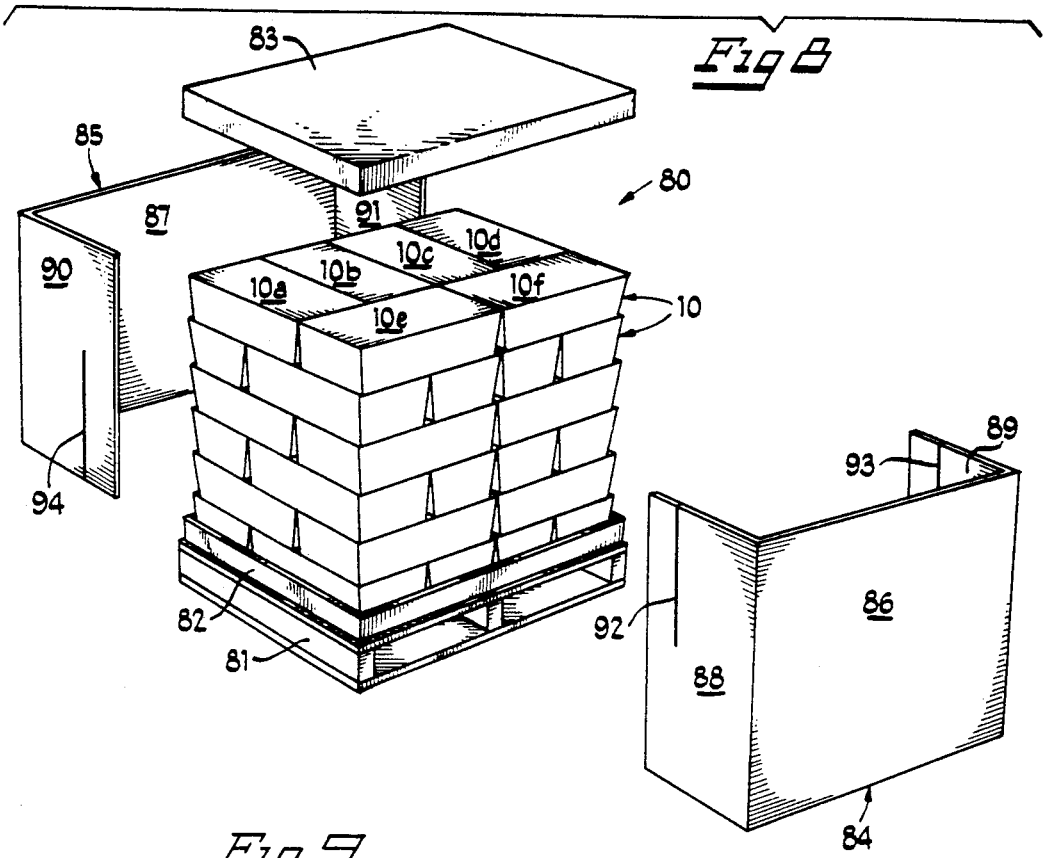
FIG. 8 is a perspective view of a pallet, bottom cap, thirty-six stacked containers, two side enclosures and a top cap illustrating the system for transporting containers made in accordance with the present invention.

FIG. 8 is an illustration of the improved system 80 provided for the transport and handling of bulk mail provided by the present invention. A standard pallet 81 is set down on the floor. A bottom cap 82 is placed on the upper surface (not shown) of the pallet 81. The bottom cap 82 is preferably of identical dimensions to the top cap 83 which reduces the cost of manufacture. The bottom cap 82 is also in substantial matching registry to the outer perimeter of the pallet 81. The containers, shown generally at 10 are of a width and length such that six containers will fit as one layer on the pallet 81 and bottom cap 82. Specifically, four containers 10*a*, 10*b*, 10*c*, 10*d* are arranged in a front panel-to-rear panel relationship along one edge of the bottom cap 82. Then, two containers 10*e* and 10*f* are arranged in a sidewall-to-sidewall manner along the ends of the containers 10*a*–10*d*. This pattern is reversed for each layer to improve stability of the stacked boxes. The system 80 shown in FIG. 8 provides for the stacking of six layers of six containers for a total of thirty-six containers.

Figure 9:
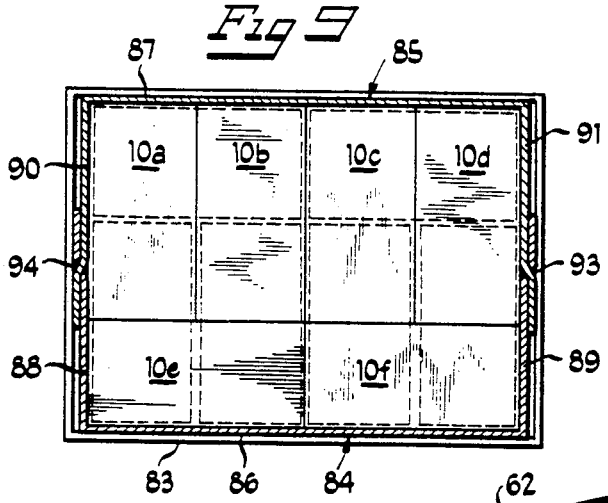
FIG. 9 is a top plan view of the system shown in FIG. 8.

The shrink wrap taught by the prior art is replaced by the two side enclosures shown at 84, 85. Each side enclosure include a main panel 86, 87 and two locking panels shown at 88, 89 and 90, 91. The locking panels 88, 90 and 89, 91 lockingly engage each other via the slits shown at 92, 93, 94 (the slit disposed in locking panel 91 is not shown). A top view of this arrangement is illustrated in FIG. 9.

Figure 10:
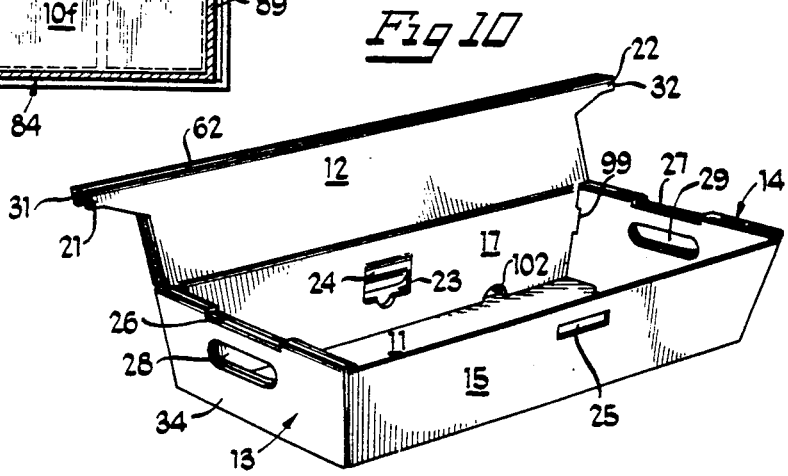
FIG. 10 is a perspective view of the container shown in FIG. 1 with the top panel folded along the center fold lines thereof and the front closure panel disposed adjacent to the rear panel, the container being in the container-loading position.

FIG. 10 is an illustration of the container 10 in the container-loading position. The top 12 is folded along fold line 62 and the front closure flap 17 is pushed back and disposed adjacent to the rear panel 16 (see FIG. 4). The locking flaps 18, 19 are folded rearward and inward and are in abutting engagement with the rear panel 16. The front closure panel 17 maintains the container-loading position shown in FIG. 10 because the lock tabs 96, 97 of the front closure flap 17 engage the slots 98, 99 of the inner walls 36, 41 (see FIG. 7). The exposed portion of the top 12 shown in FIG. 10 provides a convenient area for labeling the type of bulk mail to be placed in the container 10. The finger slots 101, 102 (see also FIG. 7) make it easy to move the top 12 from the container-loading and sorting position (FIG. 10) to the closed position (FIG. 1) despite the container 10 being filled with bulk mail.

Thus, the present invention, by providing an improved container for the sorting and stacking of bulk mail eliminates the need for the separate trays, elastic straps and sleeves. The present invention also provides an easy method of labeling each individual tray thereby making the sorting of the mail easier. The combination of a pallet, a bottom cap, a plurality of filled containers, two side enclosures and a top cap also provide an improved system for the shipping and transport of containers filled with bulk mail.

Simply put, the present invention assists both the bulk mailer and the postal service in the sorting, storage, handling and transport of bulk mail which has become an important method in the advertisement of goods and services.

Although a single preferred embodiment of the present invention has been illustrated and described, it will at once be apparent to those skilled in the art that variations may be made within the spirit and scope of the invention. Accordingly, it is intended that the scope of the present invention be limited solely by the scope of the hereafter appended claims and not by the specific wording the in the foregoing description.

We claim:

1. A container for the storage, transport and handling of bulk mail, the container comprising:

a bottom, the bottom being foldably connected to two sidewalls, a front panel and a rear panel, a to panel being foldably connected to and disposed between the rear panel and a front closure flap, each of said sidewalls providing means for holding and restraining flaps disposed on opposing ends of the front panel and the rear panel, the means for holding and restraining the flaps disposed on opposing sides of the front and rear panels maintaining the front panel and the rear panel in an upright position, the front closure flap including means for securing the top and the front closure flap in a closed position, the top including means for aligning and supporting the top while the top is in the closed position, the means for aligning and supporting the top being disposed on opposing ends of the top and matably engaging apertures disposed on opposing upper edges of the two sidewalls.

2. The container of claim 1, wherein the means for securing the top and the front closure flap in a closed position is two locking flaps disposed on opposing ends of the front closure flap, each of said locking flaps being engaged by the means for holding and restraining the flaps disposed on opposing sides of the front panel and rear panel.

3. The container of claim 1, wherein the top includes means for aligning and supporting the top while the top is in the closed position, the means for aligning and supporting the top being disposed on opposing ends of the top and matably engaging apertures disposed on opposing upper edges of the two sidewalls.

4. The container of claim 1, wherein the means for aligning and supporting the top also engage access holes in each of said sidewalls, the access holes, in combination with the means for aligning and supporting the top, providing additional means for securing the top in the closed position.

5. The container of claim 1, wherein the top includes means for folding the top inward and rearward to assume a container-loading position, an inside surface of the front closure flap being disposed adjacent to an inside surface of the rear panel when the top is in the container-loading position, each of said sidewalls including means for restraining the folded top in the container-loading position.

6. The container of claim 1, wherein the bottom and each of said sidewalls include means for maintaining each of said sidewalls in an upright position.

7. The container of claim 1, wherein the bottom includes a width and a length so that said container and a total of five other containers will fit onto an upper surface of a conventional pallet.

8. A container for the storage, transport and handling of bulk mail, the container comprising:

a bottom, two sidewalls, a front panel, a rear panel, a top;

the bottom providing a flat rectangular surface for stacking plurality of envelopes, the bottom being foldably connected to and disposed between the front panel and the rear panel, the bottom also being foldably connected to and disposed between the two sidewalls, the bottom including a plurality of slots, at least one slot disposed adjacent to each of said sidewalls;

each of said sidewalls including an outer wall which is foldably connected to the bottom, each of said sidewalls including an inner wall which is foldably connected to the outer wall of said sidewall at a common upper edge, each of said inner walls further including at least one downwardly protruding locking tab at a lower edge thereof, the inner wall of each of said sidewalls folding downward and inward and the locking tabs of each of said inner walls engaging at least one slot in the bottom to provide a folded sidewall, each of said folded sidewalls also including an aperture disposed along the common upper edge between the inner and outer walls, each of said folded sidewalls providing a space disposed between the inner wall and outer wall of each of said folded sidewalls;

the front panel including two front-end flaps, each of said front-end flaps foldably connected to the front panel at opposing ends thereof, each of said front-end flaps engaging the space between the inner and outer walls of a folded sidewall;

the rear panel including two interference flaps, each of said interference flaps foldably connected to the rear panel at opposing ends thereof, each of said interference flaps engaging the space between the inner and outer walls of a folded sidewall, an upper edge of the rear panel being foldably connected to the top;

the top including a first alignment tab and a second alignment tab and a front closure flap, each of said alignment tabs engaging one aperture disposed along the common upper edge between the inner and outer walls of the folded sidewalls, the front closure flap folding downward and abutting the front panel when the top is moved to a closed position, the front closure flap also including two locking flaps foldably connected at opposing ends of the front closure flap, each of said locking flaps engaging the space between the inner and outer walls of a folded sidewall and abutting an outer surface of one front-end flap of the front panel.

9. The container of claim 8, wherein the inner and outer walls also including an access hole disposed toward a center of each said inner and outer walls, the access holes being in matching registry when the locking tabs of the inner walls engage the slots in the bottom.

10. The container of claim 9, wherein each of said alignment tabs extending downward through an aperture and inward through an access hole to further secure the top in the closed position.

11. The container of claim 8, wherein the top includes a fold line extending from a distal outer end of the first alignment tab to a distal outer end of the second alignment tab, the top folding inward and downward and the locking flaps folding inward so that the locking flaps abut an inside surface of the rear panel and an inside surface of the front closure flap, and two fold lines disposed between the locking flaps and the front closure flap engaging two spaces between rear edges of the inner walls of the folded sidewalls and the inside surface of the rear panel.

12. The container of claim 8, wherein the bottom includes a width extending from the front to the rear panel and the bottom includes a length extending between the two sidewalls, the width being from about 9 to about 11 inches, the length being from about 20 to about 24 inches.

13. A system for the storage, transport and handling of bulk mail, the system comprising:

thirty-six containers arranged in six layers, each of said layers including six containers, a pallet, a bottom cap, a top cap, two side enclosures;

each of said containers including a bottom panel, two sidewalls, a front panel, a rear panel, and a top panel, the bottom panel being foldably connected to and disposed between each of said sidewalls, the bottom panel being foldably connected to and disposed between the front panel and the rear panel, the top panel being foldably connected to and disposed between the rear panel and a front closure flap, each said sidewalls providing means for holding and restraining flaps disposed on opposing ends of the front panel and the rear panel, the means for holding and restraining the flaps disposed on opposing sides of the front and rear panels maintaining the front panel and the rear panel in an upright position, the front closure flap including means for securing the top panel and the front closure flap in a closed position, the bottom cap being flat with four upwardly protruding side walls, each of said sidewalls being in substantial alignment with an outer edge of the pallet, the bottom cap accommodating a layer of six containers;

each said side enclosures including two locking panels, each of said locking panels including means for engaging one slit of a locking panel of the other side enclosure;

the top cap including four downwardly protruding side walls, the top matably engaging the two side enclosures.

14. The container of claim 13, wherein the system includes a conventional standard sized pallet having a surface area, the bottom cap having about the same surface area as the a pellet, each of said bottom panels of the containers having a surface area, the surface area of the bottom panels of the containers being less than one-sixth and greater than one-eighth the surface area of the bottom cap, whereby at least six containers will fit in one layer inside the sidewalls of the bottom cap.

15. The container of claim 14, wherein the side enclosures having a height, the containers having a height, the height of the containers being about one-sixth the height of the side enclosures, whereby six layers of six containers totalling thirty-six containers fit on the pallet between the bottom cap, the two side enclosures and the top cap.

16. The container of claim 13, wherein each of said side enclosures further including a main panel disposed between the two locking panels, each of said main panels being accommodated along an inside surface of a side wall of the bottom cap, the two side enclosures being arranged so that the main panels of the side enclosures are on opposing sides of the bottom cap and that each of said slits of each of said locking panels of the side enclosures engaging one slit of one locking panel of the other side enclosure.

17. A blank of foldable sheet material for forming a container body for the storage, transport and handling of bulk mail, the blank comprising:

a bottom panel, the bottom panel being foldably connected to and disposed between a front panel and a rear panel, the bottom panel also being foldably connected to and disposed between two sidewalls, the bottom panel including at least one slot disposed adjacent to each of said sidewalls, each of said sidewalls including an outer wall panel which is foldably connected to and disposed between the bottom panel and an inner wall panel, each of said inner wall panels further including at least one locking tab disposed at a distal end thereof, each of said sidewalls also including an aperture disposed along a common boundary between the inner and outer wall panels, the front panel including two front-end flaps, each of said front-end flaps foldably connected to the front panel at opposing ends thereof, the rear panel being foldably connected to and disposed between the bottom panel and the top panel, the rear panel including two interference flaps, each of said interference flaps foldably connected to the rear panel at opposing ends thereof, a top panel being foldably connected to and disposed between the rear panel and a front closure flap, the top panel including two alignment tabs, the alignment tabs being foldably connected at opposing ends of the top panel, the front closure flap including two locking flaps foldably connected at opposing ends thereof.

18. The blank of claim 17, wherein the blank is fabricated substantially from the group consisting of corrugated paperboard and polyethylene.

* * * * *